US011408204B2

(12) United States Patent
Peabody et al.

(10) Patent No.: US 11,408,204 B2
(45) Date of Patent: Aug. 9, 2022

(54) ELECTRIC STRIKE FOR INTERLOCKING LATCH MECHANISM

(71) Applicant: Hanchett Entry Systems, Inc., Phoenix, AZ (US)

(72) Inventors: Joshua T. Peabody, Phoenix, AZ (US); Dan Van Dusen, Mesa, AZ (US); John Brennan, Phoenix, AZ (US)

(73) Assignee: Hanchett Entry Systems, Inc., Phoenix, AZ (US)

( * ) Notice: Subject to any disclaimer, the term of this patent is extended or adjusted under 35 U.S.C. 154(b) by 413 days.

(21) Appl. No.: 16/397,667

(22) Filed: Apr. 29, 2019

(65) Prior Publication Data

US 2019/0330886 A1 Oct. 31, 2019

Related U.S. Application Data

(60) Provisional application No. 62/664,627, filed on Apr. 30, 2018.

(51) Int. Cl.
*E05B 47/00* (2006.01)
*E05B 15/02* (2006.01)

(52) U.S. Cl.
CPC ..... *E05B 47/0046* (2013.01); *E05B 15/0205* (2013.01); *E05B 2047/0076* (2013.01)

(58) Field of Classification Search
CPC ..... E05B 47/0046; E05B 15/0205; E05B 2047/0076; E05B 47/0047
See application file for complete search history.

(56) References Cited

U.S. PATENT DOCUMENTS

| | | | | |
|---|---|---|---|---|
| 6,390,520 | B1 * | 5/2002 | Holzer | E05B 47/0046 292/341.16 |
| 7,021,684 | B2 * | 4/2006 | Orbeta | E05B 47/0046 292/201 |
| 7,438,335 | B1 * | 10/2008 | Uyeda | E05B 47/0046 292/341.15 |
| 8,454,063 | B2 | 6/2013 | David et al. | |
| 9,702,167 | B2 * | 7/2017 | Liao | E05B 47/0046 |
| 2018/0051484 | A1 * | 2/2018 | Picard | E05B 17/22 |
| 2019/0186170 | A1 * | 6/2019 | Pfunder | E05B 39/00 |

* cited by examiner

*Primary Examiner* — Kristina R Fulton
*Assistant Examiner* — James E Ignaczewski
(74) *Attorney, Agent, or Firm* — Woods Oviatt Gilman LLP; Dennis B. Danella, Esq.

(57) ABSTRACT

An electric door strike assembly includes a housing and at least one keeper arm. The housing has an opening for admission and retraction of a door latch. The at least one keeper arm has a latch portion and is mounted on the housing. The at least one keeper arm is movable between a closed position, where the opening is occluded by the latch portion, and an open position, where the door latch may be released from the opening. The latch portion may include a bifurcated member having inside and outside legs arranged in spaced parallel relation so as to define a gap therebetween. The gap is configured to receive a latch plate of an interlocking latch mechanism when the at least one keeper arm is in the closed position.

20 Claims, 5 Drawing Sheets

ELECTRIC STRIKE FOR INTERLOCKING LATCH MECHANISM

CROSS-REFERENCE TO RELATED APPLICATIONS

The present application claims the benefit of U.S. Provisional Patent Application No. 62/664,627, filed Apr. 30, 2018, which is hereby incorporated by referenced in its entirety.

TECHNICAL FIELD

The present invention relates to mechanisms for electrically locking a door in a frame; more particularly, to an electrical door strike having movable keeper arms for selectively retaining and releasing an associated door latch, and most particularly to an electric door strike including keepers arms configured to receive an interlocking door latch.

BACKGROUND OF THE INVENTION

U.S. Pat. No. 8,454,063, entitled "Mode-Switchable Door Strike" (the '063 patent), the relevant disclosure of which is herein incorporated by reference, discloses an electric door strike assembly of the type forming the basis of this invention. As shown, latch portions 22 of keeper arms 18 are configured in the electric door strike assembly to be contacted by and withstand the force of an extended door latch when an attempt is made to open the door while the electric door strike assembly is in its locked mode.

The electric strike assembly disclosed in the '063 patent is widely used in conjunction with a Pullman-style latch mechanism. However, when used with aluminum door/door frame members, metal distortion upon a forced entry may allow an unwanted release of the latch from the strike. An interlocking latch mechanism in which a star wheel-style latch as described below is used instead of a Pullman-style latch may remedy the problem. However, heretofore, when an electrified interlocking latch mechanism was desired, whereby the door could be released from its locked position remotely, power had to be supplied to the door where the interlocking mechanism resided. An electrified strike as disclosed in the '063 patent that would be compatible with an interlocking latch mechanism was not available.

What is needed in the art is an electric door strike assembly that is compatible with an interlocking latch mechanism.

What is also needed in the art is such an electric strike assembly that would also be compatible with a Pullman-style latch mechanism.

It is a principal object of the present invention to provide such an electric strike assembly.

It is also a principal object of the present invention is to provide a means to electrify an interlocking latch mechanism for remote release whereby power is supplied to the door frame and need not be supplied to the door itself.

SUMMARY OF THE INVENTION

Briefly described, an electric door strike assembly in accordance with the present invention comprises a housing and at least one keeper arm. The housing has an opening for admission and retraction of a door latch. The at least one keeper arm has a latch portion and is mounted on the housing. The at least one keeper arm is movable between a closed position, where the opening is occluded by the latch portion, and an open position, where the door latch may be released from the opening. The latch portion includes a leg configured to receive a latch plate of an interlocking door latch mechanism when the at least one keeper arm is in the closed position.

In a further aspect of the invention, the latch portion may be a bifurcated member having inside and outside legs arranged in spaced parallel relation so as to define a gap therebetween. The gap is configured to receive a latch plate of a star wheel latch when the at least one keeper arm is in the closed position.

In yet a further aspect of the invention, respective front walls of the singular leg or the front walls of the inside and outside legs lie along a first longitudinal plane and respective back wall(s) of the leg or legs lie along a second plane. The second plane is disposed at an angle to the first longitudinal plane whereby the back wall(s) define a ramped surface. The ramped surface of the back wall(s) is configured to allow a Pullman-style latch to be received within the opening when the at least one keeper arm is in the closed position.

In still another aspect of the present invention, the at least one keeper arm is two, wherein a first keeper arm is disposed at a first side of the housing opening and a second keeper arm is disposed across the housing opening at a second side thereof. Respective front walls of the inside and outside legs of each of the first and second keeper arms lie along a common longitudinal plane and the outside leg of the first keeper arm includes a first step and wherein the outside leg of the second keeper arm includes a second step which is complementary to the first step. The first and second steps interlock with one another when the first and second keeper arms are in the closed position.

BRIEF DESCRIPTION OF THE DRAWINGS

The present invention will now be described, by way of example, with reference to the accompanying drawings, in which.

Corresponding reference characters indicate corresponding parts throughout the several views. The exemplifications set out herein illustrate currently preferred embodiments of the invention, and such exemplifications are not to be construed as limiting the scope of the invention in any manner.

DESCRIPTION OF THE PREFERRED EMBODIMENTS

Figure 1:
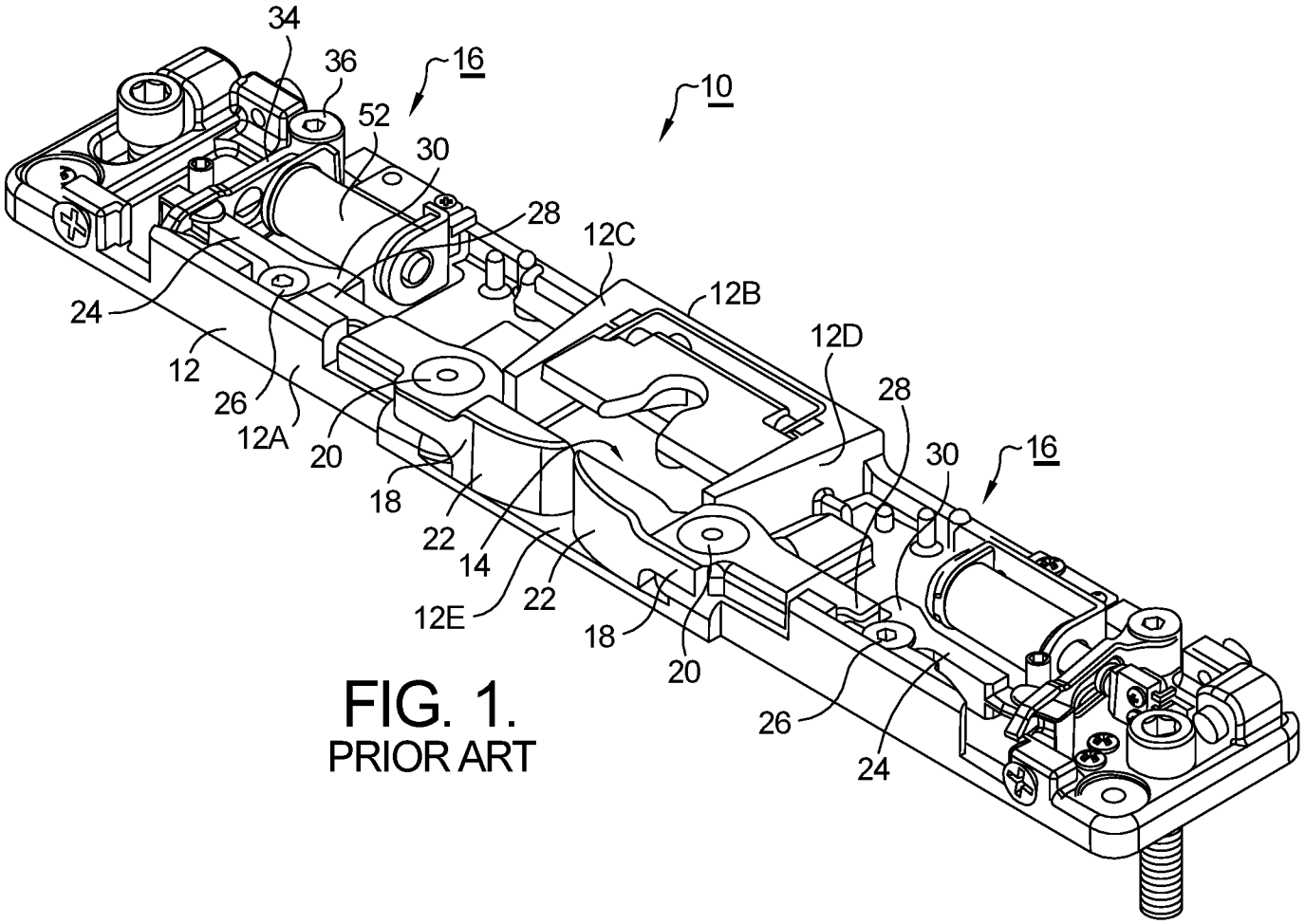
FIG. 1. PRIOR ART
FIG. 1 is an isometric view from the right front showing a prior art electric door strike assembly with the cover removed for clarity (cover is removed and not shown in all views herein)
Figure 2:
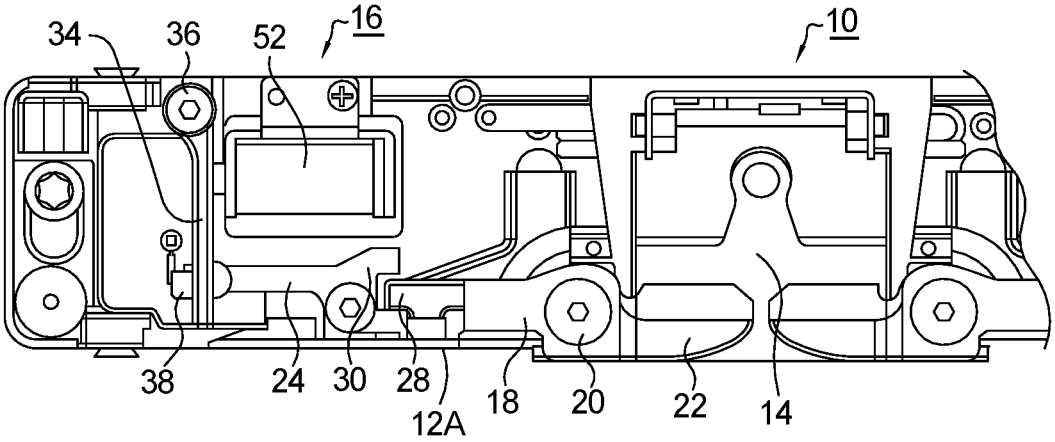
FIG. 2. PRIOR ART
FIG. 2 is a plan view of one end of the prior art electric door strike assembly shown in FIG. 1.
Figure 3:
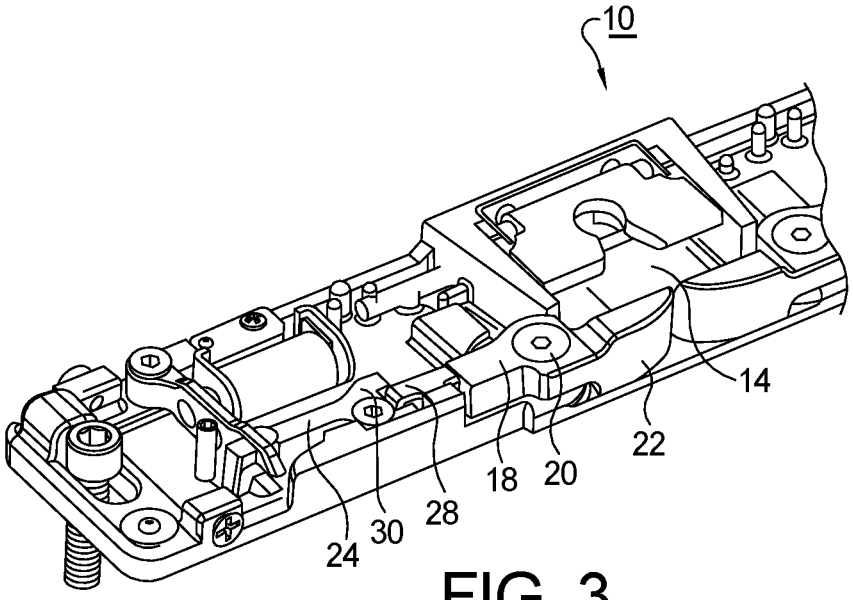
FIG. 3. PRIOR ART
FIG. 3 is an isometric view of one end of the prior art electric door strike assembly shown in FIG. 1.

Referring now to FIGS. 1 through 3, a prior art electric door strike assembly 10 comprises a housing 12 mountable to a door frame (not shown). The prior art electric door strike assembly 10 is to be regarded as exemplary in nature and does not serve to limit application of the present invention to embodiments solely thereto. The mounting of housing 12 may be either surface mounting or recessed mounting, as is well known in the prior art. A cover (not shown) protects the interior of housing 12 from tampering as well as from dirt, dust, and the like. Housing 12 includes a cutout portion 14 adapted to receive a latch (not shown) of a door (not shown) as is also known in the prior art. Cutout portion 14 is generally defined by housing rear wall 12B and cutout side walls 12C, 12D.

The referenced prior art electric door strike assembly shown in FIG. 1 preferably comprises first and second mirror-image locking mechanisms 16 mounted to housing 12 and disposed symmetrically about cutout portion 14. For simplicity and clarity in presentation, general reference may be made to only one of the two mirror-image mechanisms 16, but such reference should be considered as being equally applicable to both except as otherwise noted. The use of a pair of keeper arms 18 is presently preferred over a single keeper arm as each keeper arm of the pair is subject to only half of any force induced by the latch which, in turn, means that the strength of the device is essentially doubled.

Opposing keeper arms 18 are mounted at keeper arm pivots 20 positioned proximate the midpoint of keeper arms 18 and are positioned proximate to cutout portion 14. When keeper arms 18 are oriented in a closed position wherein their longitudinal axes are aligned in a plane generally parallel to the plane created by front housing wall 12A, latch portions 22 of arms 18 extend into and occlude cutout portion 14 thereby retaining the door latch within cutout portion 14. As is known in the prior art, when the door is moved closed, upon the door latch contacting the latch portions, the door latch retracts against a return spring force and is then free to be received by cutout portion 14, even when keeper arms 18 are in closed positions. That is, when the door is shut into a frame supporting strike assembly 10, the door latch retracts to allow passage past latch portions 22 but then snaps into cutout portion 14. Once in cutout portion 14 and when keeper arms 18 are in closed positions, the latch is trapped in cutout portion 14 and the door cannot be opened. Such keeper and strike action are well known in the art and the operation thereof will not be further discussed herein.

Keeper arms 18 are adapted to engage with transmission levers 24 mounted to housing 12 by transmission lever pivots 26. The axes of rotation of transmission lever pivots 26 are parallel to and aligned vertically with the axes of keeper arm pivots 20.

Prong 28 is positioned on each keeper arm 18 opposite latch portion 22. Prong 28 is received within a fork 30 positioned on a corresponding side of transmission lever 24 when keeper arm 18 is in a closed position.

Keeper arms 18 are resiliently urged to the closed position by springs (not visible) which may be mounted on pivots 20. One arm of each spring may engage a keeper arm 18 on its prong side and the other arm may engage a sidewall of cutout portion 14. Thus, when prongs 28 are released from forks 30, keeper arms 18 are held in the closed position only by the springs. To open the door, a user simply pushes against the door, causing the latch to rotate keeper arms 18 against the springs. Once the latch clears keeper arms 18, the keeper arms rotate back to the closed position under the urging of the springs. Further, to best position each transmission lever 24 to receive prong 28, a compression spring (not shown) may be mounted on one end thereof to fork 30 and at the other end thereof to housing 12 proximate fork 30. The compression springs urge transmission levers 24 rotatably away from housing 12 to best position fork 30 to receive prong 28.

A release lever 34 is used to control the motion of each transmission lever 24 from a rotatable state to a locked state. In the example shown, release lever 34 is mounted at one end thereof to housing 12 by release lever pivot 36. The axes of rotation of release lever pivots 36 are parallel to but offset laterally from the axes of both keeper arm pivots 20 and transmission lever pivots 26. The other ends of release levers 34 engage ends 38 of transmission levers 24 opposite forks 30. Solenoid 52, when energized, moves release lever 34 into either engagement with or disengagement from transmission lever 24, thereby locking or unlocking the transmission lever so as to allow the keeper arm to move from a latch-blocking position under a force exerted by the extended door latch when the door is opened. The conjunctive operation of the solenoid, release lever, transmission lever and keeper arm is fully described in the incorporated-by-reference '063 patent and need not be described in further detail here.

In the electric door strike assembly described above, keeper arms 18 are suitable for use with Pullman-style latch mechanisms, as are known in the art. Keeper arms 18 of an electrified strike assembly, however, are not amenable for use with a latch mechanism shown in FIG. 6 having a star wheel shaped latch (herein referred to as an "interlocking latch mechanism").

Figure 4:
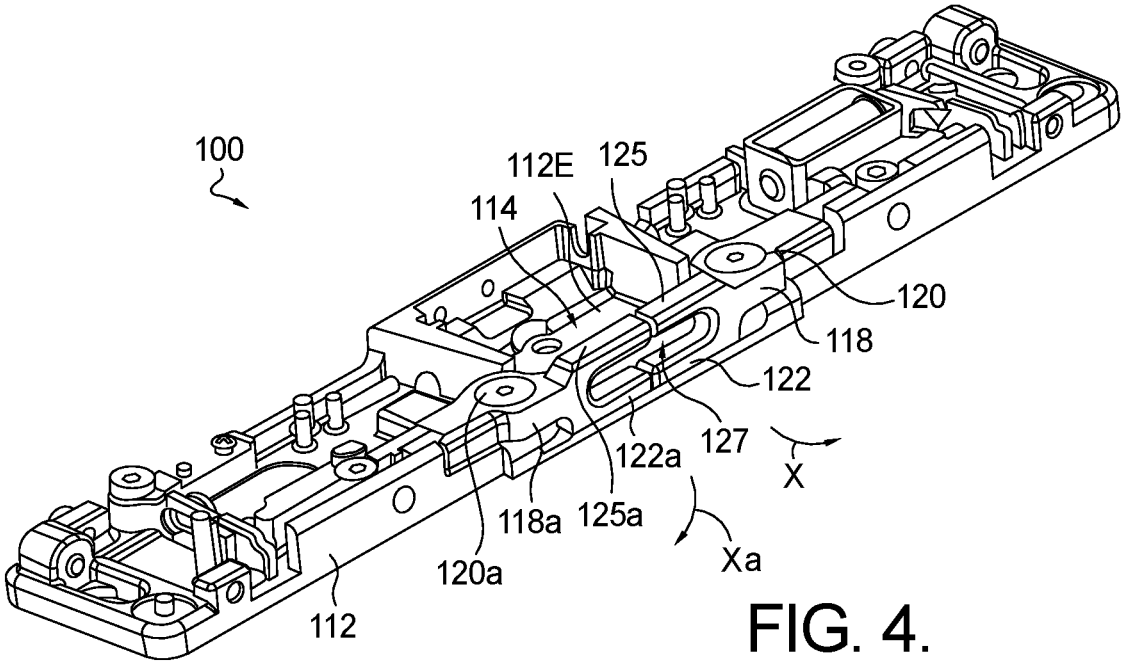
FIG. 4 is an isometric view from the right front showing an embodiment of the present invention.
Figure 5:
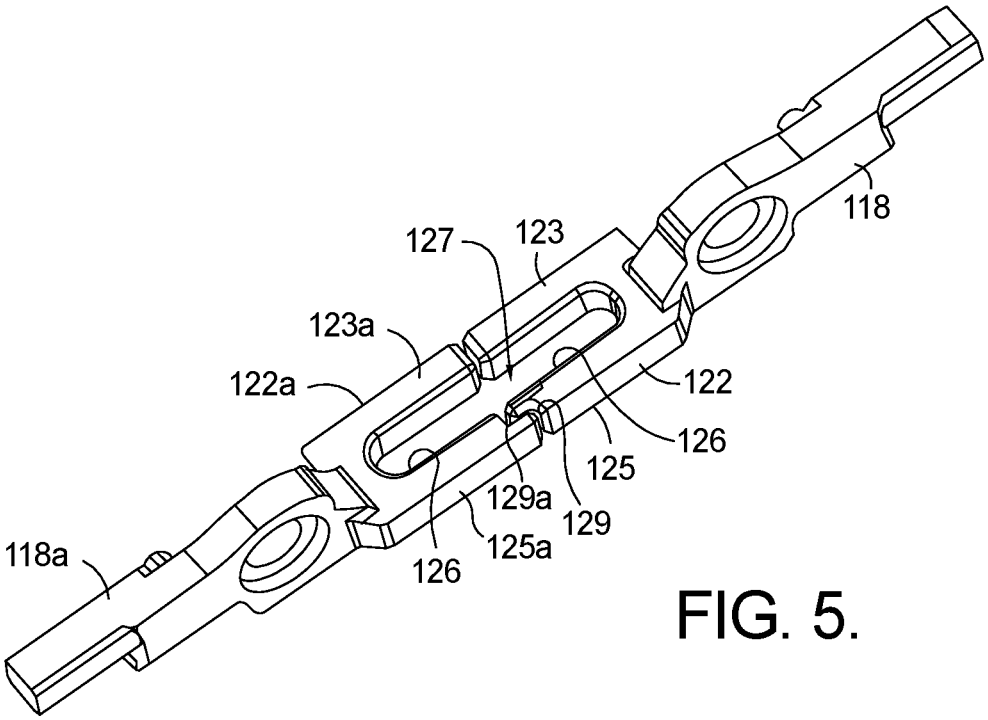
FIG. 5 is an isometric view of the keeper arms in accordance with the invention.
Figure 6:
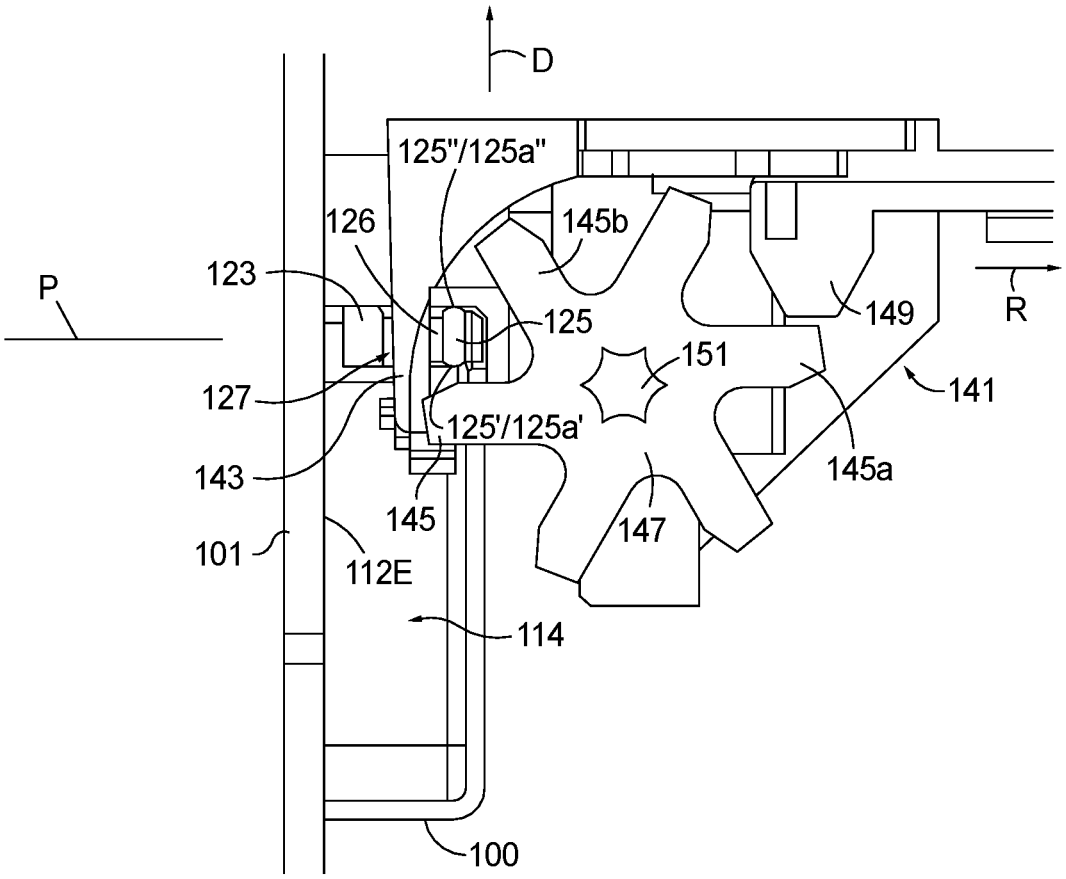
FIG. 6 is a cross-sectioned view of an interlocking latch mechanism engaged with the electric strike in accordance with the invention.

With reference to FIGS. 4 through 6, in accordance with an aspect of the present invention, an electric door strike assembly 100 includes all elements of prior art electric door strike assembly 10 except latch portions 122/122*a* of opposing keeper arms 118/118*a* are configured for use with an interlocking latch mechanism. Electric door strike assembly 100 is exemplary of a door strike amenable for including keeper arms 118/118*a* and is in no way meant to limit application keeper arms 118/118*a* solely to this embodiment. It is to be understood by those skilled in the art that keeper arms 118/118*a* may be proportioned to function within any suitable door strike device irrespective of how the solenoid operationally connects to the keeper arm or arms.

As shown most clearly in FIG. 5, each keeper arm 118/118*a* includes a respective latch portion 122/122*a*. Each latch portion 122/122*a* includes outside leg 125/125*a* wherein each outside leg 125/125*a* includes a respective edge 126. Optionally, each leg portion 122/122*a* may be bifurcated to include both a respective outside leg 125/125*a* and a respective inside leg 123/123*a* as shown in FIG. 5. As seen in FIG. 6, outside leg 125 and inside leg 123 are disposed on a first plane P that is oriented perpendicular to a door opening direction D. With reference to FIGS. 4 and 6, inside legs 123/123*a* are so designated because they are located proximate bottom surface 112E of electric door strike assembly 100 which is mounted to or within the doorframe 101 (see FIG. 6), while outside legs 125/125*a* lie toward the open doorway so as to receive the latch mechanism, such as but not limited to interlocking latch mechanism 141, when the door is closed.

Referring to FIG. 6, when keeper arms 118/118*a* are in the closed position (FIG. 4), edge 126 of outside leg 125/125*a* is disposed to receive a latch plate 143 of star latch mechanism 141. When presented as a bifurcated latch portion, a gap 127 is defined between inside leg 123/outside leg 125 and inside leg 123*a*/outside leg 125*a*, and gap 127 (and edge 126 of outside leg 125/125*a*) is configured to receive a latch plate 143 of interlocking latch mechanism 141.

To improve strike performance, outside leg 125 of latch portion 122 may include a first step 129 while outside leg 125*a* of latch portion 122*a* may include a second step 129*a* which is complementary to first step 129. As a result, first and second steps 129/129*a* may interlock or become interleaved with one another when the latch portions 122/122*a* are in the closed position, such as that shown in FIGS. 4 and 5.

With reference to FIG. 6, when the door is closed, latch plate 143 of interlocking latch mechanism 141 resides within gap 127 while both a first spoke 145 on star wheel 147 along with a portion of latch plate 143 reside within cutout portion 114 of electric door strike assembly 100 so that star wheel 147 and latch plate 143 extend around a substantial portion of outside leg 125. Clockwise rotation CW (as viewed in FIG. 6) of star wheel 147 is prevented by engagement of first spoke 145 with back wall 125' of outside leg 125. Conversely, counterclockwise rotation (CCW) of star wheel 147 is prevented by engagement of a second spoke 145*a* with a blocking member 149 of interlocking latch mechanism 141. As a result, interlocking latch mechanism 141 is locked within electric door strike assembly 100 such that unauthorized opening of the door is prohibited.

By way of example and without limitation thereto, to open the door through actuation of the latch mechanism, blocking member 149 may be translated to the right, as generally indicated by arrow R, such as through actuation of a push bar (not shown) on the unsecure side of the door (towards the bottom of FIG. 6) or keyed cylinder (not shown) on the secure side of the door (towards the top of FIG. 6). Once blocking member 149 clears second spoke 145*a*, pushing of the door towards the top of the page causes first spoke 145 to engage back wall 125' of outside leg 125 and/or back wall 125*a*' of outside leg 125*a* such that star wheel 147 of interlocking latch mechanism will rotate CCW about axis 151. Rotation about axis 151 withdraws first spoke 145 from cutout portion 114 such that the door may open. Conversely, when the open door swings closed, a spoke (such as spoke 145*b*) will engage front wall 125" of outside leg 125 and/or front wall 125*a*" of outside leg 125*a*. Star wheel 147 will then rotate clockwise until latch plate 143 is seated within gap 127. First spoke 145 also rotates to the position shown in FIG. 6 to again lock interlocking latch mechanism 141 within electric door strike assembly 100.

Alternatively, the door may be openable upon actuation of electric door strike assembly 100 as described above. With latch portions 122/122*a* freely movable within housing 112, such as and without limitation thereto, rotation about pivot 120/120*a*, pushing of the door from the unsecure side or pulling of the door from the secure side will cause first spoke 145 to engage outside leg 125/125*a* of latch portions 122/122*a*. CCW rotation of star wheel 147 is prevented by engagement of a second spoke 145*a* with blocking member 149. However, continued force against outside leg 125/125*a* of latch portions 122/122*a* by first spoke 145 causes latch portions 122/122*a* to pivot outwardly, such as in the direction shown by arrow X, Xa in FIG. 4. After latch portions 122/122*a* have pivoted a sufficient amount, first spoke 145 will clear the opening created between the two latch portions such that the door may be opened. Closing of the door and locking of the interlocking latch mechanism 141 is the same as that previously described.

It should be noted that the star wheel of an interlocking latch mechanism may come in a variety of thicknesses as measured parallel with star wheel axis 151 across spokes 145 of the starwheel. By way of example, earlier star wheels have a thickness on the order of ⅛ (0.125) inches. Other star wheels have a thickness of about ¼ (0.250) inches which may lead to a stronger, more durable latch mechanism. The electric strike as described above is compatible with either star wheel thicknesses.

Figure 7:
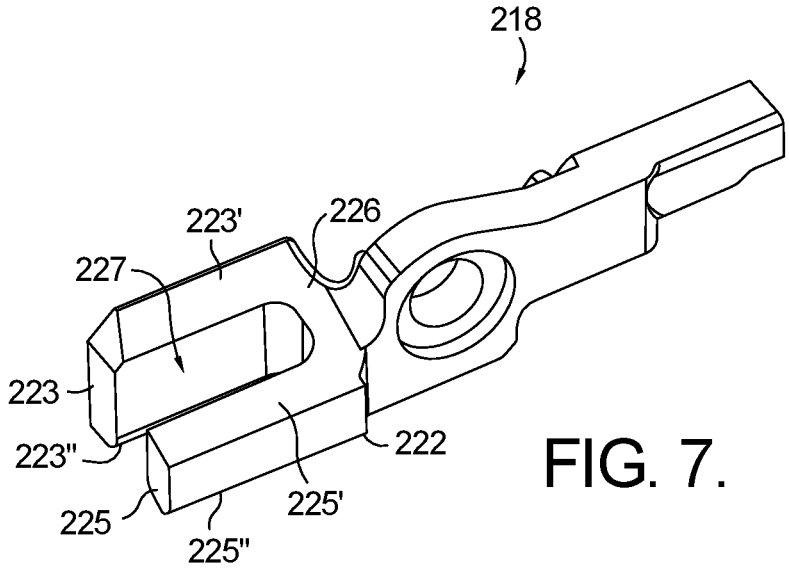
FIGS. 7 and 8 are views of an optional keeper arm in accordance with the invention that may also be used with a Pullman-type latch mechanism.
Figure 8:
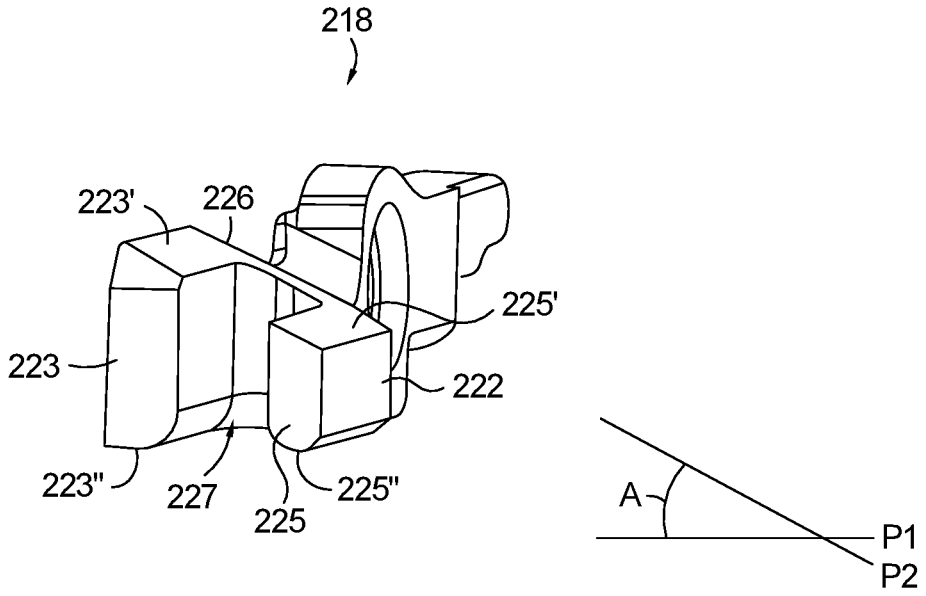

Turning now to FIGS. 7 and 8, an alternative keeper arm 218 is shown. Keeper arm 218 is identical to keeper arm 118 except latch portion 222 includes a ramped surface 226. As shown in FIGS. 7 and 8, respective front walls 223" and 225" of the inside and outside legs 223/225 lie along a first longitudinal plane P1. Respective back walls 223' and 225' of the inside and outside legs 223/225 lie along a second plane P2. Second plane P2 is disposed at an angle A to first longitudinal plane P1 whereby the back walls 223'/225' define ramped surface 226. Ramped surface 226 is configured such that a Pullman-style latch mechanism may be received within cutout 114 instead of an interlocking latch mechanism as described above.

Note that the ramp surface described above may be provided on the front wall of a keeper portion having only one leg with equal effect.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. An electric strike assembly for use with an interlocking door latch mechanism to selectively secure a door relative to a door frame, wherein the door latch mechanism includes a movable door latch and a latch plate, the electric strike assembly comprising:

a) a housing including a bottom surface, wherein the housing defines a cut out portion for admission and release of the interlocking door latch mechanism; and b) at least one keeper arm having a latch portion, wherein the at least one keeper arm is mounted to the housing, wherein the at least one keeper arm is movable between a closed position wherein the cut out portion is occluded by the latch portion and an open position wherein the door latch of the interlocking door latch mechanism may be released from the cut out portion, wherein the latch portion of the at least one keeper arm comprises a first leg, and wherein the first leg includes an edge, wherein the edge of the first leg is configured to be adjacent to the latch plate of the interlocking door latch mechanism so that the latch plate is disposed between the edge and the bottom surface when the at least one keeper arm is in the closed position, and wherein at least a portion of the latch plate and the moveable door latch are both disposed in the cut out portion when the at least one keeper arm is in the closed position to selectively secure the door relative to the door frame.

2. The electric strike assembly in accordance with claim 1, wherein the latch portion of the at least one keeper arm further comprises a second leg so as to define a gap between the first leg and the second leg, and wherein the gap is configured to receive the latch plate when the at least one keeper arm is in the closed position.

3. The electric strike assembly in accordance with claim 1 wherein a front wall of the first leg lies along a first longitudinal plane, wherein a back wall of the first leg lies along a second longitudinal plane which is disposed at an angle to the first longitudinal plane whereby the back wall defines a ramped surface, and wherein the back wall is disposed in a position to engage the movable door latch when the at least one keeper arm is in the closed position to selectively secure the door relative to the door frame.

4. The electric strike assembly in accordance with claim 1 wherein the at least one keeper is a first keeper arm, and wherein the electric strike assembly further comprises a second keeper arm having a second latch portion, wherein the second keeper arm is mounted to the housing, and movable between a closed position wherein the cut out portion is occluded by the second latch portion and an open position wherein the door latch of the interlocking door latch mechanism may be released from the cut out portion, wherein the second latch portion comprises a first leg, and wherein the first leg of the second latch portion includes an edge wherein the edge of the first leg of the second latch portion is configured to be adjacent to the latch plate of the interlocking door latch mechanism when the second keeper arm is in the closed position, and wherein at least a portion of the latch plate and the moveable door latch are both disposed in the cut out portion when the second keeper arm is in the closed position to selectively secure the door relative to the door frame.

5. The electric strike assembly in accordance with claim 4 wherein the first leg of the first keeper arm includes a first step, and wherein the first leg of the second keeper arm includes a second step which is complementary to the first step whereby the first and second steps interlock with one another when the first and second keeper arms are in the closed position.

6. The electric strike assembly in accordance with claim 1 wherein the door latch of the interlocking door latch mechanism includes a star wheel latch.

7. The electric strike assembly in accordance with claim 6 wherein the star wheel latch includes at least one spoke, wherein the at least one spoke is directly contactable by the at least one keeper arm when the at least one keeper arm is in the closed position.

8. The electric strike assembly in accordance with claim 1 wherein the first leg is configured to be positioned between the movable door latch and the latch plate of the interlocking door latch mechanism.

9. The electric strike assembly in accordance with claim 1, wherein the moveable door latch and the latch plate extend around a substantial portion of the first leg of the at least one keeper portion when the door is in the closed position.

10. The electric strike assembly in accordance with claim 1, wherein the door latch mechanism further includes a moveable blocking member having a blocking position and an unblocking position, wherein the movable door latch is a star wheel, wherein the star wheel includes a first spoke and a second spoke, wherein at least a portion of the first spoke is disposed in the cut out portion when the at least one keeper arm is in the closed position, and wherein the second spoke is disposed adjacent to the movable blocking member when in the blocking position to selectively maintain the first spoke in the cut out portion thereby securing the door relative to the door frame.

11. The electric strike assembly in accordance with claim 2, wherein when the door moves from a door closed position toward a door opened position, the door moves in a first direction, and wherein the first leg and the second leg are disposed on a first plane that is disposed perpendicular to the first direction.

12. The electric strike assembly in accordance with claim 3, wherein when the door moves from a door closed position toward a door opened position, the door moves in a first direction, and wherein the first longitudinal plane is perpendicular to the first direction.

13. An interlocking door latch mechanism configured to operate in conjunction with an electric strike assembly to selectively secure a door relative to a door frame, wherein the electric strike assembly includes a housing and at least one keeper arm, wherein the housing includes a bottom surface and defines a cut out portion for admission and release of the interlocking door latch mechanism, wherein the at least one keeper arm is movable between a closed position and an open position and configured to selectively occlude the cut out portion of the housing when in the closed position, wherein said at least one keeper arm includes a first leg having an edge, the interlocking door latch mechanism comprising:

a) a door latch configured to be positioned in the cut out portion of the housing, and releasable from the cut out portion when the at least one keeper arm is in the open position; and b) a latch plate, wherein the latch plate is positioned adjacent to the first edge of the first leg so that the latch plate is disposed between the first edge and the bottom surface when the cut out portion is occluded by the at least one keeper arm, and wherein at least a portion of the latch plate and the door latch are both disposed in the cut out portion when the at least one keeper arm is in the closed position to selectively secure the door relative to the door frame.

14. The interlocking door latch mechanism in accordance with claim 13, wherein the at least one keeper further comprises a second leg so as to define a gap between the first leg and the second leg, and wherein the latch plate is received in the gap when the cut out portion is occluded by the at least one keeper arm.

15. The interlocking door latch mechanism in accordance with claim 13, wherein the interlocking latch mechanism includes a star wheel latch.

16. The interlocking door latch mechanism in accordance with claim 13 wherein the latch plate and the door latch are positioned around the first leg.

17. An assembly to selectively secure a door relative to a door frame, the assembly comprising:

a) an electric strike assembly including:

i) a housing including a bottom surface, wherein the housing defines a cut out portion; and ii) at least one keeper arm mounted to the housing and movable between a closed position and an open position, wherein the at least one keeper arm includes a first leg having an edge; and b) an interlocking door latch assembly including:

i) a door latch configured to be received in the cut out portion of the housing and releasable from the cut out portion when the at least one keeper arm is in the open position; and ii) a latch plate, wherein the edge of said first leg of the at least one keeper arm is positioned adjacent to the latch plate so that the latch plate is disposed between the edge and the bottom surface when the at least one keeper arm is in the closed position, and wherein at least a portion of the latch plate and the moveable door latch are both disposed in the cut out portion when the at least one keeper arm is in the closed position to selectively secure the door relative to the door frame.

18. The assembly in accordance with claim 17 wherein the at least one keeper arm further includes a second leg so as to define a gap between the first leg and the second leg, and wherein the gap is configured to receive the latch plate when the at least one keeper arm is in the closed position.

19. The assembly in accordance with claim 17 wherein the door latch is a star wheel latch.

20. The assembly in accordance with claim 17 wherein the first leg is configured to be positioned between the door latch and the latch plate of the door latch assembly.

* * * * *